United States Patent [19]

Colaianni

[11] 4,069,734

[45] Jan. 24, 1978

[54] MOISTURE TRAP FOR CLARINETS

[76] Inventor: Flammarion R. Colaianni, 25 Franklin St., Milford, Mass. 01757

[21] Appl. No.: 740,104

[22] Filed: Nov. 9, 1976

[51] Int. Cl.[2] ..... G10D 7/06

[52] U.S. Cl. ..... 84/382; 84/397

[58] Field of Search ..... 84/380, 382, 383 R, 84/397

[56] References Cited

U.S. PATENT DOCUMENTS

| | | | |
|---|---|---|---|
| 1,349,722 | 8/1920 | Jagger et al. | 84/397 |
| 1,480,039 | 1/1924 | Alpers | 84/380 X |
| 2,457,473 | 12/1948 | Incampo | 84/382 |
| 3,844,193 | 10/1974 | Marchi | 84/382 |

*Primary Examiner*—Lawrence R. Franklin
*Attorney, Agent, or Firm*—Clarence L. Carlson

[57] ABSTRACT

A pocket within the barrel of a clarinet for accumulating moisture introduced into the bore of the barrel from the mouthpiece and a valve controlled opening communicating with both the pocket and exterior surface of the barrel which can be selectively opened to clear the pocket and opening of moisture accumulated therein as desired.

6 Claims, 6 Drawing Figures

MOISTURE TRAP FOR CLARINETS

BACKGROUND OF THE INVENTION

The invention pertains to clarinets and more particularly to a moisture trap for such musical instruments.

As is well known to musicians familiar with wind reed instruments the accumulation of moisture during the course of an evening's playing is of a substantial amount.

Numerous arrangements and devices are utilized and available for the accumulation and release of moisture from such musical instruments as the saxaphone, trumpet and trombone and yet considering the great number of years that the clarinet has been one of the more popular musical instruments, the only means by which moisture can escape is to pass through the barrel and body portions and thence outwardly through the flared or bell end of the instrument.

U.S. Pat. No. 2,457,473 shows and describes a water absorbing device for clarinets which is in the form of a sponge that is adapted to assemble in the bell end of a clarinet.

The lack of an effective means to prevent moisture from entering the body portion of a clarinet creates many troublesome and undesirable conditions such for example when moisture enters into this portion of the instrument it saturates the various keys and their pads and has a corrosive effect on the various movable metallic elements.

The build up of moisture, during extended playing, within the body portion of the clarinet has an adverse affect on the quality of the instrument's tone which is especially noticeable to the musician himself and his colleagues. This can be attributed to a minute spray of moisture which is caused to accompany the flow of air passing outwardly through any one of the ports which the musician has selectively opened to play a particular note.

Additionally the accumulation of moisture within a clarinet necessitates an increase in air pressure to properly play the instrument and contributes considerably to the tiring of the musician during the extended playing engagements with which they are frequently involved.

The moisture trap for clarinets comprising the invention has overcome the troublesome and undesirable conditions described above by providing a trap located within the barrel of a clarinet which will prevent moisture from entering the body portion thereof. It also includes means operatively associated with the trap for selectively removing the moisture accumulated therein.

SUMMARY OF THE INVENTION

The moisture trap for clarinets according to the invention defines a pocket formed in the side wall of a clarinet's barrel. The barrel has a central bore that communicates with counterbores formed in each end of said barrel which serve to operatively interconnect a mouthpiece with the body portion of a clarinet. The pocket is disposed in communication with the central bore and an opening formed in the side wall of the barrel has one end disposed in communication with said pocket and the opposite end with the exterior surface of the barrel. A moisture release valve is pivotably mounted on the exterior surface of the barrel and includes a biasing means for continuously urging said valve in a direction to close that end of the opening communicating with said exterior surface.

A fingering lever is operatively connected to the valve and provides a means for selectively pivoting said valve away from the opening so as to clear the pocket and opening of moisture accumulated therein from the central bore and which was introduced into the latter from the mouthpiece.

It is a general object of the invention to provide a clarinet with means for trapping and selectively releasing moisture introduced therein from the instrument's mouthpiece.

Another object is to provide a means for accumulating moisture within a clarinet which is disposed so as to trap the moisture before it can enter the body portion of the instrument.

A further object is to provide a means for accumulating and selectively releasing moisture introduced into a clarinet which is of simplified construction inexpensive to manufacture and that is readily adaptable to both new and instruments now in use.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
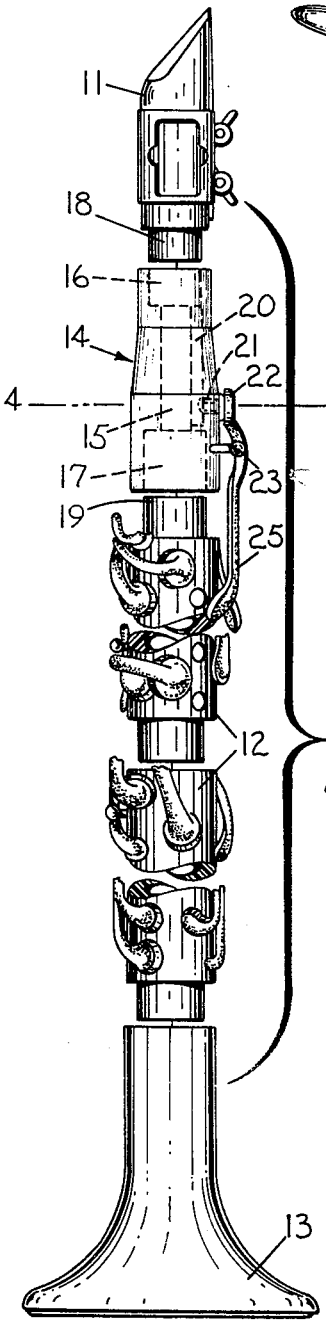
FIG. 1 is an exploded view in side elevation of a clarinet showing by means of dotted lines the moisture trap according to the invention applied thereto.
Figure 3:
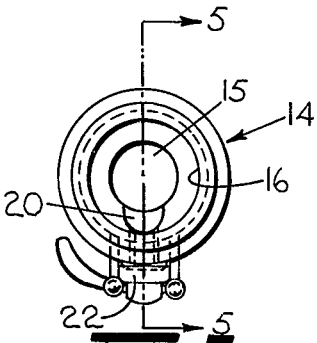
FIG. 3 is an end view of the barrel shown in FIG. 1 as seen looking downwardly from that end within which the mouthpiece assembles.
Figure 4:
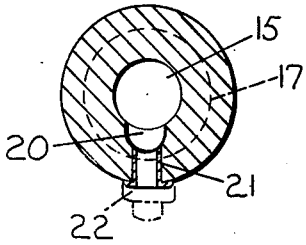
FIG. 4 is a sectional view of the barrel taken along line 4—4 in FIG. 1.

Referring now to FIG. 1 a well known form of clarinet is identified generally by numeral 10 and includes a mouthpiece 11 and a body portion 12 the latter of which is provided with the usual compliment of finger holes and keys with their associated actuating levers.

A flared or bell end 13 forms that end of the clarinet opposite the mouthpiece 11 and assembles to the body portion 12 in a manner well known to those familiar with this type of instrument.

The barrel of the clarinet is identified generally by numeral 14 and serves to operatively interconnect the mouthpiece 11 with the body portion 12. The barrel includes a centrally disposed bore 15 which communicates at one end with a counterbore 16 and at the opposite end with a counterbore 17. A necked portion 18 on the mouthpiece serves to interconnect the latter with the barrel 14 by being pressed into counterbore 16. A necked portion 19 (FIG. 1) on the body portion serves to interconnect the latter with the barrel 14 by means of a press fit into counterbore 17.

The moisture trap comprising the invention is formed in the side wall of the barrel and defines a pocket 20 that communicates with the bore 15. This pocket 20 which communicates with the bore 15 extends parallel therewith for a substantial portion of said bore's length. One end of the pocket 20 is disposed in communication with the counterbore 16 and the opposite end terminates within the side wall of the barrel at a location adjacent to the counterbore 17.

A flanged bushing 21 is assembled within a drilled hole provided in the side wall of the barrel 14 in a manner whereby the flanged portion is disposed in contiguous relation with the exterior surface of said barrel and the opposite end is disposed in communication with the pocket 20.

A moisture release valve 22 is pivotably mounted on the exterior surface of the barrel 14 as at 23 and includes a biasing means in the form of a spring 24. This spring serves to continuously urge the valve 22 toward the flange portion of bushing 21 which provides a seat for said valve.

Figure 2:
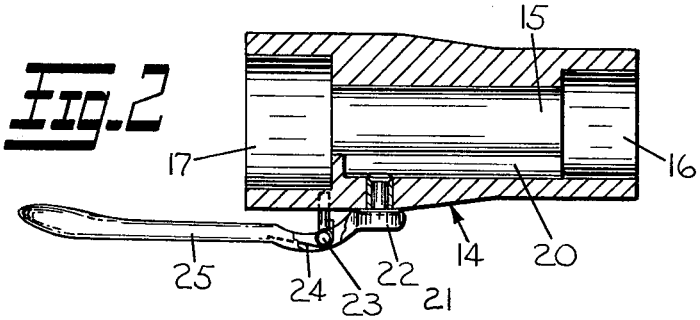
FIG. 2 is a sectional view of the clarinet barrel showing a moisture release valve in operative association with the moisture trap and one form of fingering lever for opening the valve.
Figure 5:
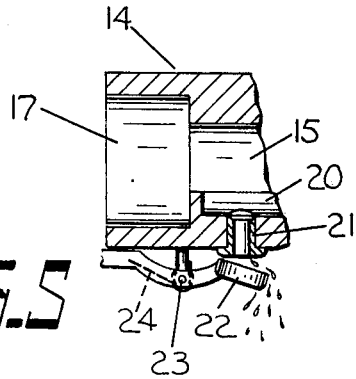
FIG. 5 is a sectional view of a portion of the barrel as seen looking in the direction of the indicating arrows of line 5—5 in FIG. 3.

As shown in FIG. 2, the valve 22 includes an elongated fingering lever 25 connected thereto which extends in a direction generally parallel with the axis of the barrel 14 and clarinet body 12 and provides a means for selectively opening said valve as shown in FIG. 5.

Figure 6:
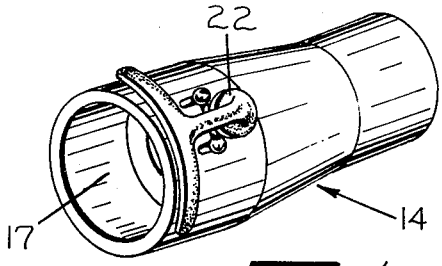
FIG. 6 is a perspective view of the barrel showing a modification of the fingering lever for opening the valve.

Referring to FIG. 6 a modification of the means for opening valve 22 is shown and defines an arcuated fingering lever 26. This fingering lever 26 is connected intermediate its ends to the valve 22 and with the ends thereof being disposed on opposite sides of and in close proximity with the outer surface of the barrel 14.

To summarize the invention its testing under actual extended playing engagements has substantially alleviated the problems heretofore described and very effectively accumulates moisture within the pocket 20 that is introduced with air during the playing of the instrument. By simply opening the moisture release valve 22 by depressing the fingering lever 25 whenever it is deemed desirable, the accumulated moisture within the pocket 20 and bushing 21 is very quickly cleared therefrom.

Additionally the use of the invention under actual playing conditions has demonstrated to possess another feature considered to be very desirable. By opening the valve 22 during the playing of notes on the high register creates a condition whereby said notes are clearer and more mellow. The invention in addition to providing a means for controlling the accumulation of moisture in a clarinet can be utilized as a support key to enrich the tone of clarinet notes on the high register.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a clarinet having a barrel including a centrally disposed bore with counterbores formed on each end thereof for operatively interconnecting a mouthpiece to the clarinet body, the improvement comprising:

a. a pocket formed in the side wall of the barrel in communication with the bore having means forming an opening extending generally radially to the axis of the bore with one end communicating with said pocket and the opposite end with the exterior of the barrel;

b. a moisture release valve pivotably mounted on the barrel with biasing means operatively connected thereto for continually urging said valve to a first position for closing said opposite end of said opening; and c. means connected to said valve for selectively moving the latter from said first position to a second position for opening said opposite end and clearing said pocket and opening of moisture accumulated therein from the bore and introduced from the mouthpiece.

2. The structure according to claim 1 wherein said means forming an opening defines a bushing assembled in the side wall of the barrel having a flange forming said opposite end defining a seat for said valve.

3. The structure according to claim 1 wherein said pocket extends parallel with and for a portion of the length of the bore.

4. The structure according to claim 1 wherein one end of said pocket communicates with the counterbore for receiving the mouthpiece and the opposite end terminates adjacent to the counterbore for receiving the clarinet body.

5. The structure according to claim 1 wherein said means for selectively moving said valve defines an elongated fingering lever extending in a direction generally parallel with the axis of the barrel and clarinet body.

6. The structure according to claim 1 wherein said means for selectively moving said valve defines an arcuated fingering lever connected intermediate its ends to said valve with the ends thereof being disposed on opposite sides of and in close proximity with the outer surface of the barrel.

* * * * *